United States Patent [19]

Arthurs

[11] Patent Number: 5,009,314

[45] Date of Patent: Apr. 23, 1991

[54] BOTTLE CARRIER ASSEMBLY

[75] Inventor: Raymond C. Arthurs, Scarborough, Canada

[73] Assignee: Saepter Manufacturing Company Limited, Don Mills, Canada

[21] Appl. No.: 374,648

[22] Filed: Jun. 30, 1989

[51] Int. Cl.[5] ..... B65D 21/02; B65D 1/24; B65D 85/00

[52] U.S. Cl. ..... 206/427; 206/503; 206/509; 206/821; 220/509; 220/630

[58] Field of Search ..... 206/203, 427, 503, 509, 206/821; 220/21, 69

[56] References Cited

U.S. PATENT DOCUMENTS

| | | | |
|---|---|---|---|
| 3,521,777 | 7/1970 | Vik | 206/821 |
| 3,863,759 | 4/1975 | Prodel | 220/21 |
| 3,986,628 | 10/1976 | Prodel | 220/21 |
| 4,071,162 | 1/1978 | Steinlein | 220/21 |
| 4,326,629 | 4/1982 | Tate | 220/21 |
| 4,582,447 | 4/1986 | Itoh | 206/821 |
| 4,615,443 | 11/1986 | Deffner | 206/427 |

FOREIGN PATENT DOCUMENTS

| | | | |
|---|---|---|---|
| 1177567 | 9/1964 | Fed. Rep. of Germany | 220/69 |
| 2811565 | 9/1979 | Fed. Rep. of Germany | 220/69 |

*Primary Examiner*—George E. Lowrance
*Attorney, Agent, or Firm*—Blake, Cassels, Graydon

[57] ABSTRACT

The invention concerns assemblies or displays of plastic bottle carriers. Bottle carriers are assembled for palletization or display on an assembly plate having upstanding prongs which fit into corresponding sockets in the base of adjacent bottle carriers. The prongs and sockets are such that when the assembly is subjected to lateral pressure, for example, by palletizing machinery each prong is gripped in its socket so that the bottle carriers and the plate are an assembled unit. Preferably when no under lateral pressure, the prongs are freely slidable in the socket.

7 Claims, 4 Drawing Sheets

BOTTLE CARRIER ASSEMBLY

BACKGROUND OF THE INVENTION

1. Field of the Invention

The invention relates to an assembly of bottle carriers especially for handling by palletizing machinery, an assembly plate for such assemblies and to a method of palletizing bottle carriers.

2. Background of the Invention

Frequently bottle carriers, for example for soft drink bottles, are formed as a rectangular frame having two rows of three bottle carrying cells. One reason for this is for convenience of the domestic consumer, since it has become apparent that carriers for many more than six bottles are less convenient for a variety of reasons which may include weight and expense. Various prior art bottle carriers are directed to bottle carriers for six bottles such as those described in U.S. Pat. No. 210,930 to Box, U.S. Pat. No. Des. 160,608 to Jones, U.S. Pat. No. Des. 202,303 to Struble, U.S. Pat. No. Des. 237,686 to Torokvei, U.S. Pat. No. 3,404,805 to Stockman et al., and U.S. Pat. No. 4,060,517 Torokvei issued Aug. 9th, 1977.

For handling prior to delivery to the domestic consumer, however, carriers of six bottles are inconveniently small. Therefore, it is usual to first assemble the carriers in pairs to form cases of twelve bottles and thereafter to stack a plurality of cases into pallets, each layer of which is formed of a plurality of cases. Usually the cases (pairs of carriers) or the layers of the pallet, stand on a tray with an upstanding rim or are banded together by a peripheral band. In this case, it is common that abutting surfaces between cases in a layer of a pallet are not aligned but that the cases in a layer are arranged for example in rows of four cases having their short sides parallel, (each short side comprising the long side of a carrier and corresponding to three bottles) and three cases having their long sides parallel, (each long side comprising two short sides of carriers and corresponding to four bottles). Such, and similar, arrangements may aid stability to the pallet.

Torokvei, in previously mentioned U.S. Pat. No. 4,040,517, discloses a bottle carrier having a recess in its base into which a handle of an empty bottle carrier in a lower layer fits when the empty cases are stacked. This is intended for space saving and to provide stability to the stack of empty carriers. Such a bottle carrier may be provided with a downwardly extending tongue lying between adjacent bottles as shown in registered Design No. 45580.

SUMMARY OF THE INVENTION

According to one aspect of the invention, there is provided an assembly of adjacent bottle carriers comprising a plurality generally two carriers and a connecting device therefore, the connecting device comprising a base plate having upstanding prongs fitting into corresponding sockets of adjacent bottle carriers.

More particularly, according to one aspect of the invention, there is provided an assembly of adjacent bottle carriers, each formed of resilient plastic material and each of generally rectangular plan having a base, side walls, end walls and upstanding internal walls forming a plurality of bottle accommodating cells, and each carrier having a socket through the base extending upwardly between cells, and a tongue extending downwardly within the socket between bottle carrying cells; and an assembly plate extending under said carriers and having upstanding prongs, a prong fitting into a corresponding socket of each carrier adjacent the tongue whereby, on peripheral pressure on the assembly the prong bears against the tongue to hold the plate against falling.

Also, according to another aspect of the invention, there is provided in an assembly of adjacent bottle carriers, each formed of resilient plastics material and each of generally rectangular plan having a base, side walls, end walls and upstanding internal walls forming a plurality of bottle accommodating cells, and each carrier having a socket through the base and extending upwardly between cells, and a tongue extending downwardly within the socket between the bottle carrying cells; an assembly plate extending under said carriers and having upstanding prongs, each prong fitting freely into a corresponding socket of each carrier adjacent the tongue whereby, on peripheral pressure on the assembly the prong bears against the tongue to hold the plate against falling.

BRIEF DESCRIPTION OF THE DRAWINGS

An embodiment of the invention will now be described by way of example with reference to the drawings in which.

DESCRIPTION OF PREFERRED EMBODIMENT

Figure 1:
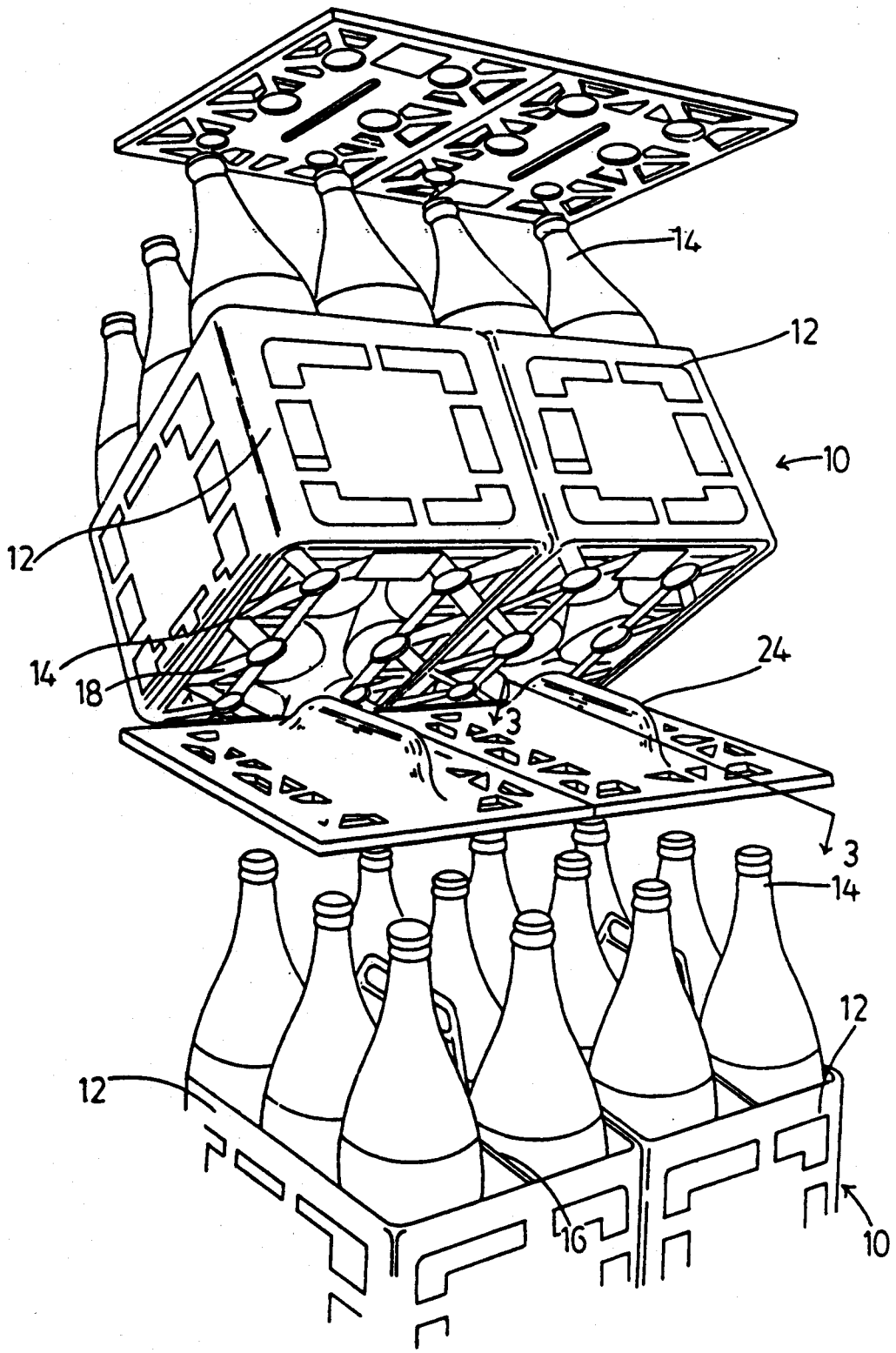
FIG. 1 is a sketch of two pairs of adjacent bottle carriers, showing their relation an assembly plate.
Figure 2:
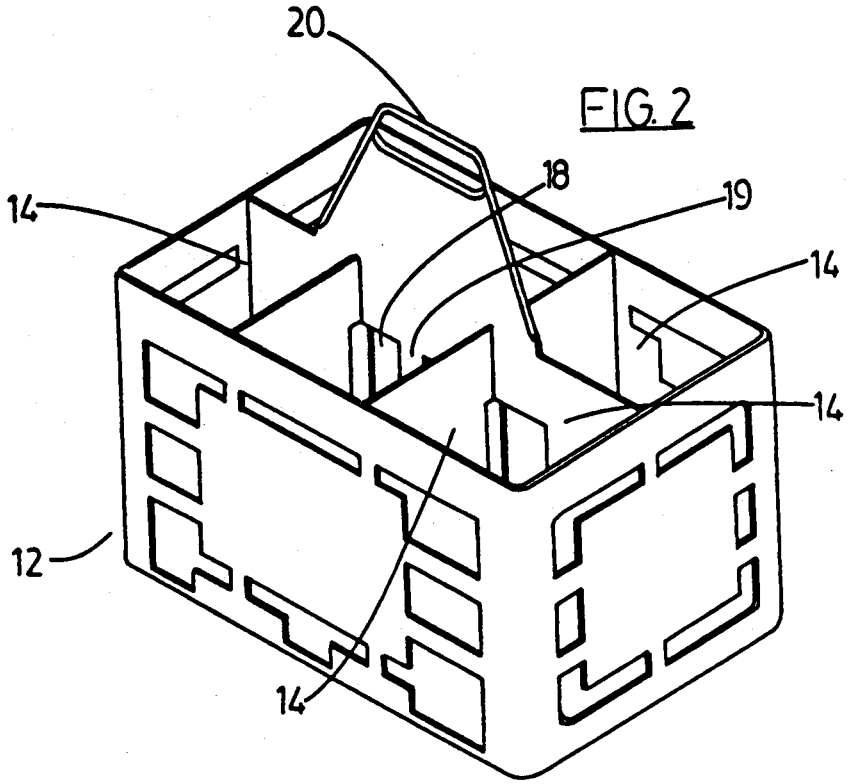
FIG. 2 shows a single empty bottle carrier suitable for use in the assembly of FIG. 1.
Figure 3:
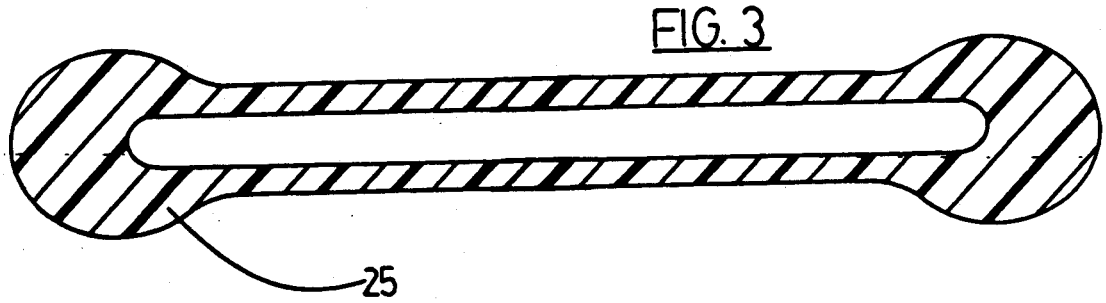
FIG. 3 is a cross-section of the handle plug of the connection means of FIG. 1.

A case 10 may be made up of two bottle carriers 12 with their long sides adjacent. Such a carrier is convenient for deposit of bottles 14 into it twelve at a time, in configurations of 4 by 3. The bottle carriers may be made from resilient plastic material, e.g. polyethylene.

Each bottle carrier 12 may be a carrier for six bottles as described in U.S. Pat. No. 4,040,517 having two rows of three bottle accommodating cells 14 to each side of a central dividing wall 16. The bottle carrier described in the U.S. patent has a recess 18 in the central dividing wall 16 adapted to receive an upstanding handle 20 when the empty carriers are stacked. In practice, although not described in the U.S. patent, it has become usual to provide a tongue 19 extending downwardly in the recess to inhibit knocking together of at least the two central bottles through of the recess 16.

When such bottle carriers 12 have been used, stacking the empty carriers has been by registering the handles 20 of a lower layer of carriers in recesses 18 of an upper layer. However, for filling and palletizing, it has been conventional to assemble the above described bottle carriers 12 and other types of bottle carriers on trays, having an upstanding retaining lip to hold the carriers in position on the trays.

In the illustrated embodiment, a connecting plate 22 is provided, its area being coextensive with the area of the base of case 10. The plate 22 may conveniently be made of polyethylene, but other materials may be equally suitable. Two upstanding handles 24 are provided on the plate 22 to fit freely into recesses 18 of bottle carriers 12 of case 10. Tongue 19 may fit alongside handle 24 without difficulty.

There is no technical reason that connecting plate 22 should be coextensive in area with the base of case 10 provided that it is sufficiently large that handles 24 may be spaced to fit into recesses 18 of case 10. However, by making the plate 22 of at least substantially the same size and shape as the base of case 10, the plate 22 may be used as a useful display stand when the case is in its final retail location.

Conveniently, when the handle 24 and recess 18 have the generally rectangular form illustrated and tongue 19 depends downwardly within the socket in the plane of the dividing wall 14, the handle 24 may be formed to be thicker at its margins 25 to provide grip for any person lifting the plate by handle 24. Moreover, the thicker margin provides a base for grip by the bottle carrier 12, as will be described. The handles 24 may be made hollow, opening to the bottom of plate 22, so that the plates 24 may be stacked with each handle 24 fitting into the hollow of the next above handle 24.

In operation, a pair of bottle carriers 12 forming a case 10 are assembled with their long sides adjacent and with handles 24 of connecting plate 22 located snugly but freely in recesses 18. While this description relates to assembly of a pair of bottle carriers each for six bottles, it should be understood that no limitation to such numbers or configurations is intended. It has become conventional that bottle carriers for two rows of these bottles are used, e.g. for the convenience of the domestic consumer, and that cases of three rows of four bottles are used for conformity with conventional bottle packing machinery. It should, however, be clear that the connecting plate 22 may be of a size suitable for more than two carriers and that any number of prongs or handles 24 may be provided according to the number of bottle carriers to be assembled. Thus, in principle, there is no reason why a single connecting plate 22 having twelve prongs or handles 24 be provided for the layout sketched in FIG. 4.

Figure 4:
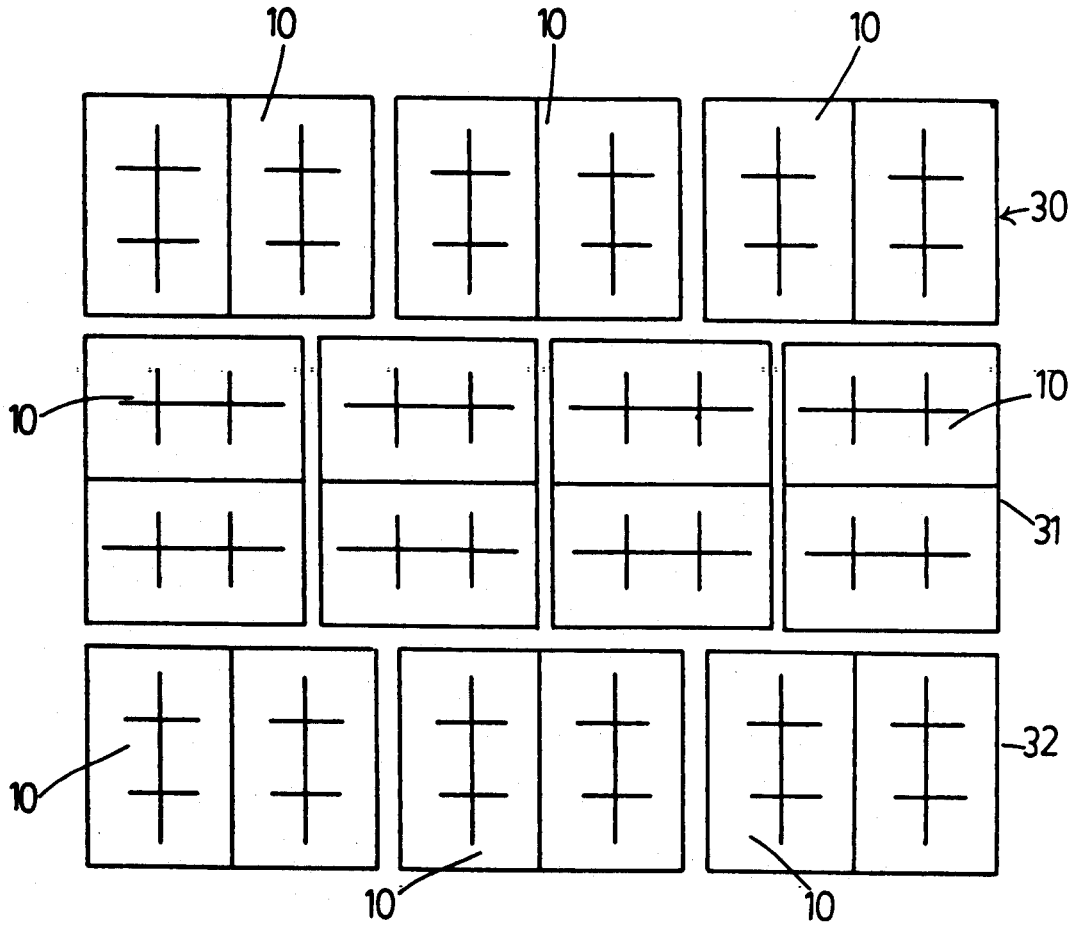
FIG. 4 shows a layout of carriers and cases in a pallet layer.
Figure 5:
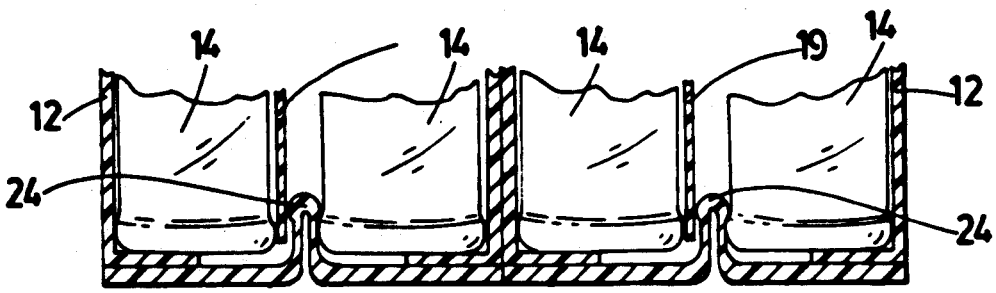
FIG. 5 shows a detail of the carrier with the prong freely movable with respect to the tongue.
Figure 6:
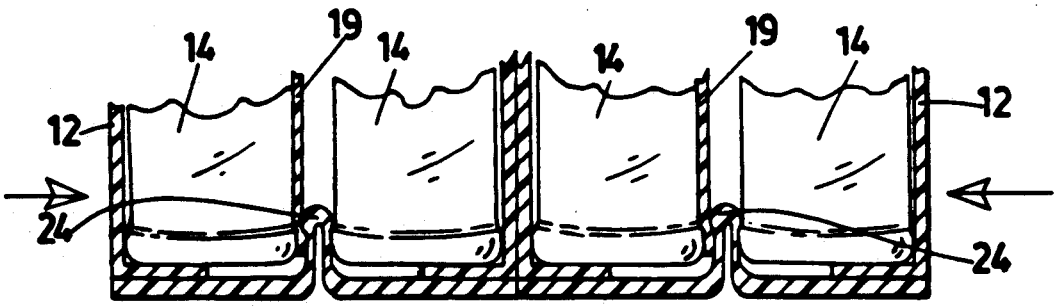
FIG. 6 shows a similar detail of the carrier with the prong jammed against the tongue.

Each case 10 is handled by a palletizer for assembly into a pallet layer as, for example, set out in FIG. 4. The palletizer may apply pressure on all four sides of the case 10 to grip it for moving it to a different location. At least, the palletizer applies pressure on two sides of the case, e.g. at all four corners. Due to this pressure and to the resiliency of the material from which the bottle carriers 12 are formed, there is a tendency to compress the case 10 and thereby tighten the fit between recesses 18 and handles 24. Thus, handles 24 fit freely into recesses 18 when no pressure is exerted on case 10 and, in that condition, a bottle carrier 12 may be lifted from plate 22, the handle 24 sliding out of recess 18. Under constrictive palletizing pressure, however, the tongue 19 and handle 24 are forced together in functional engagement to hold the carrier and plate together. Moreover, carriers 12, and the case 10, are compressed tending to reduce the size of each recess 18. The handle 24 may thus be gripped firmly. When the handles 24 have thickened margins 25 as described, the friction is greater around the margins 25. Resilient deformation may cause part of the bottle carrier to bulge towards the thinner central part or handle 24 to embrace the thicker part to enhance the gripping effect. Thus, when case 10 is lifted by the palletizer, connecting plate 22 is lifted also, holding the carriers 12 assembled securely. When palletizing pressure is relieved, resilience of the carriers biases the recess size back to the original and the handle 24 may be again freely slidable in the recess 18. The action of the prong on handle 24 with the tongue 19 is seen in FIGS. 5 and 6.

Although it is possible to provide plate 22 in the form of a tray with an upstanding lip to further confine bottle carriers 12 in assembled cases, such lip is not necessary. Until now, the presence of such a confining lip or band for bottles in the trays was believed necessary. Such a lip or band may have interfered with direct secure grip of the palletizer on the bottle carriers themselves. The absence or reduced depth of such peripheral lip in the present case may result in improved grip of the palletizer on cases 10.

Cases 10 may be arranged in pallet layers as shown in FIG. 4. While any arrangement of cases 10 is possible, it may be convenient to provide layers which comprise two rows of four cases with their short sides adjacent, and one row of three cases with their long sides adjacent. Stacking may be such that the orientation of rows is different in different layers. By this means, a degree of dovetailing between cases of different layers may be provided to add stability to the stack. Thus in FIG. 4, which shows a sketch of a pallet layer in plan, a first row 30 comprises three cases 10 and a third row 32 comprises four cases 10. Such a total number of cases is a suitable number for a layer of a stack. In other layers, row 31 comprising three cases 10 might be positioned as in the positions shown for either rows 30 or 32 in FIG. 4.

I claim:

1. An assembly of adjacent bottle carriers, each formed of resilient plastic material and each of generally rectangular plan having a base, side walls, end walls and upstanding internal walls forming a plurality of bottle accommodating cells, and each carrier having a socket through the base extending upwardly between cells, and a tongue extending downwardly within the socket between the bottle carrying cells; and an assembly plate extending under said carriers and having upstanding prongs, a prong fitting into a corresponding socket of each carrier adjacent the tongue whereby, on peripheral pressure on the assembly the prong bears against the tongue to hold the plate against falling.

2. An assembly as claimed in claim 1 in which each prong fits into the corresponding socket in a freely removable manner when peripheral pressure is not applied to the assembly.

3. An assembly as claimed in claim 2 in which each bottle carrier has six bottle accommodating cells formed by a central internal dividing wall parallel to the side walls and two internal partition walls parallel with the end walls and in which the socket of each bottle carrier comprises a cut away section of the central internal dividing wall through the base and the tongue has in the plane of the central dividing wall in the cut away section.

4. An assembly as claimed in claim 3 in which each prong of the plate is formed as a handle therefor and comprises an upstanding tongue corresponding in configuration to the cut away section of the bottle carrier.

5. An assembly as claimed in claim 4 in which each handle is provided with a thickened margin for at least part of its free edge.

6. An assembly as claimed in claim 4 in which the number of bottle carriers is two.

7. In an assembly of adjacent bottle carriers, each formed of resilient plastic material and each of generally rectangular plan having a base, side walls, end walls and upstanding internal walls forming a plurality of bottle accommodating cells, and each carrier having a socket through the base and extending upwardly between cells, and a tongue extending downwardly within the socket between bottle carrying cells; an assembly plate extending under said carriers and having upstanding prongs, each prong fitting freely into a corresponding socket of each carrier whereby, on peripheral pressure on the assembly to cause resilient deformation of the plastic material, the fit of each prong in each socket tightens to hold the plate against falling.

* * * * *